US008299148B2

(12) United States Patent
Ikegame et al.

(10) Patent No.: US 8,299,148 B2
(45) Date of Patent: Oct. 30, 2012

(54) POLYLACTIC ACID FIBER AND MANUFACTURING METHOD THEREOF

(75) Inventors: Midori Ikegame, Iwakuni (JP); Takaaki Matsuda, Iwakuni (JP); Shin To, Tokyo (JP)

(73) Assignees: Teijin Limited, Osaka (JP); Musashino Chemical Laboratory, Ltd., Tokyo (JP)

( * ) Notice: Subject to any disclaimer, the term of this patent is extended or adjusted under 35 U.S.C. 154(b) by 56 days.

(21) Appl. No.: 12/439,773

(22) PCT Filed: Sep. 3, 2007

(86) PCT No.: PCT/JP2007/067548

§ 371 (c)(1),
(2), (4) Date: May 1, 2009

(87) PCT Pub. No.: WO2008/029934

PCT Pub. Date: Mar. 13, 2008

(65) Prior Publication Data

US 2010/0004362 A1 Jan. 7, 2010

(30) Foreign Application Priority Data

Sep. 4, 2006 (JP) ..... 2006-238928

(51) Int. Cl.
*C07F 9/6574* (2006.01)

(52) U.S. Cl. ..... 524/117; 524/140; 264/103

(58) Field of Classification Search ..... 524/117
See application file for complete search history.

(56) References Cited

U.S. PATENT DOCUMENTS 4,719,246 A 1/1988 Murdoch et al.
5,010,145 A * 4/1991 Ikada et al. ..... 525/415
2005/0001358 A1 1/2005 Nakazawa et al.

FOREIGN PATENT DOCUMENTS

| | | | |
|---|---|---|---|
| EP | 1312702 | A1 | 5/2003 |
| EP | 1939336 | A1 | 7/2008 |
| JP | 63241024 | A | 10/1988 |
| JP | 10036651 | A | 2/1998 |
| JP | 2000017164 | A | 1/2000 |
| JP | 2001226571 | A | 8/2001 |
| JP | 2003-192883 | A | 7/2003 |
| JP | 2003192884 | A | 7/2003 |
| JP | 2003278078 | A | 10/2003 |

(Continued)

OTHER PUBLICATIONS

Machine translation of JP 2005-023512.*
Machine translation of JP 2007-070750.*

(Continued)

*Primary Examiner* — Doris Lee
(74) *Attorney, Agent, or Firm* — Sughrue Mion, PLLC

(57) ABSTRACT

An object of the present invention is to provide a fiber made of polylactic acid and having excellent strength, heat resistance and heat shrinkage resistance and a manufacturing method thereof. The present invention relates to the fiber is made of a composition which includes (i) poly(L-lactic acid) having a weight average molecular weight of 50,000 to 300,000 (component A), (ii) poly(D-lactic acid) having a weight average molecular weight of 50,000 to 300,000 (component B) and (iii) 0.01 to 5 parts by weight of a phosphate metal salt (component C) based on 100 parts by weight of the total of the components A and B and has a strength of 2.5 to 10 cN/dTex and a manufacturing method thereof.

6 Claims, 1 Drawing Sheet

FOREIGN PATENT DOCUMENTS

| | | | | |
|---|---|---|---|---|
| JP | 2003293220 | A | | 10/2003 |
| JP | 2005-023512 | | * | 1/2005 |
| JP | 2005023512 | A | | 1/2005 |
| JP | 2005187626 | A | | 7/2005 |
| JP | 2006016447 | A | | 1/2006 |
| JP | 2007023393 | A | | 2/2007 |
| JP | 2007-070750 | | * | 3/2007 |
| WO | 03057781 | A1 | | 7/2003 |
| WO | 2007046397 | A1 | | 4/2007 |

OTHER PUBLICATIONS

Tsuji et al; Stereocomplex Formation between Enantiomeric Poly(lactic acid)s. 3. Calorimetric Studies on Blend Films Cast from Dilute Solution; Macromolecules, American Chemical Society (1991); vol. 24; pp. 5651-5656.

Yamane et al.; Polylactic Acid Stereo-Complex Fiber; Semi Gakkai Preprints; Faculty of Textile Science (1989); pp. 1-3,F-133.

European Search Report dated Sep. 4, 2009 (corresponding to European Application No. 07806980.4).

* cited by examiner

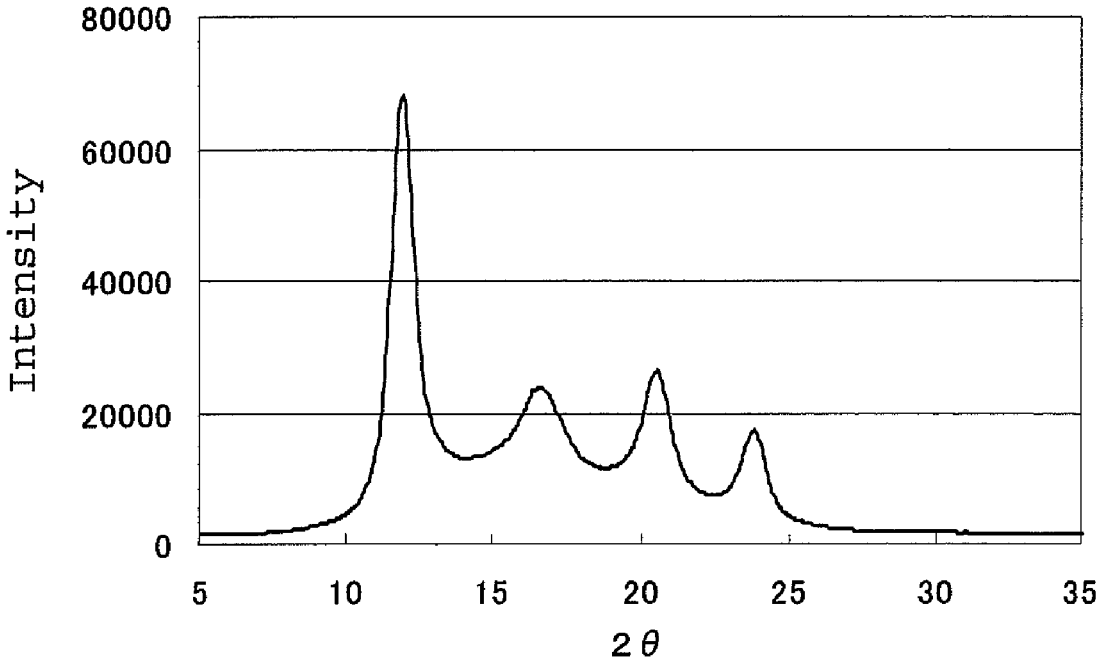
80000
60000
40000
20000
0
Intensity
5
10
15
20
25
30
35
2θ

POLYLACTIC ACID FIBER AND MANUFACTURING METHOD THEREOF

CROSS REFERENCE TO RELATED APPLICATIONS

This application is a National Stage of International Application No. PCT/JP2007/067548 filed Sep. 3, 2007, claiming priority based on Japanese Patent Application No. 2006-238928 filed Sep. 4, 2006, the contents of all of which are incorporated herein by reference in their entirety.

TECHNICAL FIELD

The present invention relates to a fiber made of polylactic acid and having practical strength, heat resistance and low heat shrinkability and a manufacturing method thereof. The present invention also relates to a fiber product comprising the above fiber.

BACKGROUND ART

Biodegradable polymers which are decomposed in the natural environment are attracting attention and being studied worldwide for the purpose of global environmental protection. As the biodegradable polymers, there are known polyhydroxybutyrate, polycaprolactone, aliphatic polyesters and polylactic acid. They can be melt molded and are expected to be used as general-purpose polymers. Since lactic acid or lactide which is the raw material of polylactic acid out of these can be manufactured from natural products, use of the polylactic acid not as just a biodegradable polymer but as a general-purpose polymer prepared by taking global environment into consideration is now under study. Although the polylactic acid has high transparency and toughness, it is easily hydrolyzed in the presence of water and decomposed without contaminating the environment after it is scrapped. Therefore, it is expected to be used as a general-purpose polymer having a small environmental load.

Since the melting point of the polylactic acid is in the range of 150 to 170° C., when it is used as a apparel fiber, the temperature for ironing the fiber is limited to a low temperature. When it is used as an industrial fiber, it is not suitable for use as a rubber material or resin coated dishcloth which is exposed to a high temperature of about 150° C. as a production temperature.

Meanwhile, it is known that when poly(L-lactic acid) which is composed of only an L-lactic acid unit (may be referred to as "PLLA" hereinafter) and poly(D-lactic acid) which is composed of only a D-lactic acid unit (may be referred to as "PDLA" hereinafter) are mixed together in a solution or molten state, stereocomplex polylactic acid is formed (non-patent document 1). It is also known that this stereocomplex polylactic acid has a higher melting point than those of PLLA and PDLA and shows high crystallinity. Various studies on fibers made of the stereocomplex polylactic acid are also under way.

For example, patent document 1 discloses a stereocomplex polylactic acid fiber obtained by melt spinning a composition containing equimolar amounts of poly(L-lactic acid) and poly (D-lactic acid). However, the stereocomplex polylactic acid fiber is unsatisfactory in terms of heat resistance and cannot be put to practical use.

Non-patent document 2 discloses that a stereocomplex polylactic acid fiber is obtained by melt spinning. This document teaches that the stereocomplex fiber is obtained by heating unstretched yarn obtained by melt spinning a molten blend of poly(L-lactic acid) and poly(D-lactic acid). However, as molecular orientation in the inside of the fiber is alleviated at the time of heating, the strength of the obtained fiber is only 2.3 cN/dTex.

In the conventional stereocomplex forming method, amorphous unstretched yarn obtained by spinning a blend of poly (L-lactic acid) and poly(D-lactic acid) is stretched and heated. That is, in the prior art, based on the idea that it is efficient to heat stereocomplex at a temperature equal to or higher than the melting point of a poly(L-lactic acid) or poly(D-lactic acid) homocrystal in order to fully grow the stereocomplex, the heat treatment is mainly carried out at a temperature higher than the melting point of the homocrystal. It has been certain that this high-temperature heat treatment has been effective for the formation of the stereocomplex. However, when the heat treatment is carried out at a high temperature, the partial melting of the yarn occurs, whereby the yarn becomes rough and hard, or its strength lowers.

To cope with this problem, patent document 2 proposes a method of forming stereocomplex from molten polylactic acid on the line of spun yarn. For example, it is proposed that the partial melting of the yarn should be improved by carrying out spinning at a high rate of 4,000 m/min and stretching crystallized unstretched yarn having a stereo crystallization ratio of 10 to 35% when measured by wide-angle X-ray diffraction (XRD) to 1.4 to 2.3 times. However, to carry out this method, a spinning rate of 3,000 m/min is not satisfactory and a special spinning apparatus for spinning at a rate of not less than 5,000 m/min is required. Therefore, there are problems to be solved for carrying out this method industrially. As for the evaluation of heat resistance in this proposal, an iron heated at 170° C. is applied to a tubular knit fabric of the fiber to see a significant change such as a rupture or roughening and hardening of the knitted fabric, but the shrinkage of apparel made of apparel fibers is not studied at all. Thus, heat resistance is not studied completely. A technology for manufacturing a fiber having a high stereo crystallization ratio and excellent strength and heat shrinkage resistance from unstretched yarn having a stereo crystallization ratio of 0% is not accomplished yet.

Patent document 3 proposes a fiber having two peaks derived from a polylactic acid homocrystal and a stereocomplex crystal at 190° C. or higher and a heat resistance of 200° C., which is obtained by stretching unstretched yarn obtained by melt spinning at a spinning draft of not less than 50 and a take-up rate of not less than 300 m/min to 2.8 times after the unstretched yarn is wound up or without winding it up and by heating it at 120 to 180° C.

Meanwhile, patent document 4 proposes that a phosphate metal salt is contained in polylactic acid capable forming stereocomplex as a crystal nucleating agent to improve the heat resistance and impact resistance of a molded article.

(patent document 1) JP-A 63-241024
(Patent Document 2) JP-A 2003-293220
(Patent Document 3) JP-A 2005-23512
(patent document 4) JP-A 2003-192884
(non-patent document 1) Macromolecules, 24, 5651 (1991)
(non-patent document 2) Seni Gakkai Preprints (1989)

DISCLOSURE OF THE INVENTION

It is an object of the present invention to provide a fiber which is made of polylactic acid and excellent in strength, heat resistance and heat shrinkage resistance and a manufacturing method thereof. It is another object of the present invention to provide a fiber product comprising the fiber.

The inventors of the present invention have found that, when a phosphate metal salt (component C) is existent at the time of melt spinning poly(L-lactic acid) (component A) and poly(D-lactic acid) (component B), unstretched yarn made of substantially amorphous stereocomplex is obtained. They have also found that, even when this unstretched yarn is stretched, low-temperature melting peaks derived from poly (L-lactic acid) and poly(D-lactic acid) are not seen. They have further found that, even when the stretched yarn is heated at a high temperature, the partial melting of polylactic acid is not seen. The present invention has been accomplished based on these findings.

That is, the present invention is a fiber made of a composition which comprises (i) poly(L-lactic acid) having a weight average molecular weight of 50,000 to 300,000 (component A), (ii) poly(D-lactic acid) having a weight average molecular weight of 50,000 to 300,000 (component B) and (iii) 0.01 to 5 parts by weight of a phosphate metal salt (component C) based on 100 parts by weight of the total of the components A and B and having a strength of 2.5 to 10 cN/dTex.

The present invention is a method of manufacturing a fiber, comprising the steps of:

(1) melt spinning a composition which comprises (i) poly (L-lactic acid) having a weight average molecular weight of 50,000 to 300,000 (component A), (ii) poly(D-lactic acid) having a weight average molecular weight of 50,000 to 300,000 (component B) and (iii) 0.01 to 5 parts by weight of a phosphate metal salt (component C) based on 100 parts by weight of the total of the components A and B to obtain unstretched yarn;

(2) stretching the unstretched yarn to obtain stretched yarn; and (3) heating the stretched yarn at 150 to 220° C.

BRIEF DESCRIPTION OF THE DRAWINGS

FIG. 1 shows a diffraction intensity profile in the equator direction for obtaining a stereo crystallization ratio (Sc ratio) in Examples.

BEST MODE FOR CARRYING OUT THE INVENTION

The present invention will be described hereinunder.

<Method of Manufacturing a Fiber>

The fiber of the present invention can be manufactured by the steps of (1) melt spinning a composition which comprises poly(L-lactic acid) (component A), poly(D-lactic acid) (component B) and a phosphate metal salt (component C) to obtain unstretched yarn, (2) stretching the unstretched yarn to obtain stretched yarn, and (3) heating the stretched yarn at 150 to 220° C.

(poly(L-lactic Acid): Component A)

The poly(L-lactic acid) is mainly composed of an L-lactic acid unit. The L-lactic acid unit is a recurring unit derived from L-lactic acid. The poly(L-lactic acid) comprises preferably 90 to 100 mol %, more preferably 95 to 100 mol %, much more preferably 98 to 100 mol % of the L-lactic acid unit. The other recurring units are a D-lactic acid unit and a unit except lactic acid. The total content of the D-lactic acid unit and the unit except lactic acid is preferably 0 to 10 mol %, more preferably 0 to 5 mol %, much more preferably 0 to 2 mol %.

The unit except lactic acid is a unit derived from at least one monomer selected from hydroxycarboxylic acids such as glycolic acid, caprolactone, butyrolactone and propiolactone, aliphatic diols having 2 to 30 carbon atoms such as ethylene glycol, 1,3-propanediol, 1,2-propanediol, 1,4-propanediol, 1,5-propanediol, hexanediol, ocatanediol, decanediol and dodecanediol, aliphatic dicarboxylic acids having 2 to 30 carbon atoms such as succinic acid, maleic acid and adipic acid, aromatic diols such as terephthalic acid, isophthalic acid, hydroxybenzoic acid and hydroquinone, and aromatic dicarboxylic acids.

The poly(L-lactic acid) preferably has crystallinity.

Its melting point is preferably 150 to 190° C., more preferably 160 to 190° C. When these conditions are satisfied, a stereocomplex crystal having a high melting point can be formed, and crystallinity can be increased.

The poly(L-lactic acid) has a weight average molecular weight of preferably 50,000 to 300,000, more preferably 100,000 to 250,000.

(poly(D-lactic Acid): Component B)

The poly(D-lactic acid) is mainly composed of a D-lactic acid unit. The D-lactic acid unit is a recurring unit derived from D-lactic acid. The poly(D-lactic acid) comprises preferably 90 to 100 mol %, more preferably 95 to 100 mol %, much more preferably 98 to 100 mol % of the D-lactic acid unit. The other recurring units are an L-lactic acid unit and a unit except lactic acid. The total content of the L-lactic acid unit and the unit except lactic acid is preferably 0 to 10 mol %, more preferably 0 to 5 mol %, much more preferably 0 to 2 mol %.

The unit except lactic acid is a unit derived from at least one monomer selected from hydroxycarboxylic acids such as glycolic acid, caprolactone, butyrolactone and propiolactone, aliphatic diols having 2 to 30 carbon atoms such as ethylene glycol, 1,3-propanediol, 1,2-propanediol, 1,4-propanediol, 1,5-propanediol, hexanediol, ocatanediol, decanediol and dodecanediol, aliphatic dicarboxylic acids having 2 to 30 carbon atoms such as succinic acid, maleic acid and adipic acid, aromatic diols such as terephthalic acid, isophthalic acid, hydroxybenzoic acid and hydroquinone, and aromatic dicarboxylic acids.

The poly(D-lactic acid) preferably has crystallinity. Its melting point is preferably 150 to 190° C., more preferably 160 to 190° C. When these conditions are satisfied, a stereocomplex crystal having a high melting point can be formed, and crystallinity can be increased.

The poly(D-lactic acid) has a weight average molecular weight of preferably 50,000 to 300,000, more preferably 100,000 to 250,000.

The poly(L-lactic acid) or the poly(D-lactic acid) can be manufactured by directly dehydrating and condensing L-lactic acid or D-lactic acid or by cyclodehydrating L-lactic acid or D-lactic acid to obtain lactide and ring-opening polymerizing it. Examples of the catalyst used in these methods include divalent tin compounds such as tin octylate, tin chloride and tin alkoxide, tetravalent tin compounds such as tin oxide, butyltin oxide and ethyltin oxide, metal tin, zinc compounds, aluminum compounds, calcium compounds and lanthanide compounds.

It is preferred that the polymerization catalyst used at the time of polymerization should be cleaned by solvents to be removed from the poly(L-lactic acid) and the poly(D-lactic acid) or that its catalytic activity should be inactivated. A catalyst deactivator may be used to inactivate the catalytic activity.

The catalyst deactivator is at least one selected from the group consisting of organic ligands consisting of chelate ligands which have an imino group and can coordinate to the metal polymerization catalyst, phosphorus oxo acid, phosphorus oxo acid esters and organic phosphorus oxo acid compounds represented by the formula (3). The catalyst deactivator is used in an amount of preferably 0.3 to 20 equivalents, more preferably 0.4 to 15 equivalents, much more preferably 0.5 to 10 equivalents based on 1 equivalent of the metal element contained in the catalyst at the end of polymerization.

$$X_1—P(=O)_m(OH)_n(OX_2)_{2-n} \quad (3)$$

In the above formula, m is 0 or 1, n is 1 or 2, and $X_1$ and $X_2$ are each independently a hydrocarbon group which may have a substituent having 1 to 20 carbon atoms. Examples of the hydrocarbon group include alkyl groups having 1 to 20 carbon atoms such as methyl group, ethyl group, propyl group and butyl group.

The content of the metal ion in the poly(L-lactic acid) and the poly(D-lactic acid) is preferably not more than 20 ppm from the viewpoints of the heat resistance and hydrolysis resistance of the fiber. As for the content of the metal ion, the content of a metal selected from alkali earth metals, rare earth metals, the transition metals of the third period, aluminum, germanium, tin and antimony is preferably not more than 20 ppm.

(Phosphate Metal Salt: Component C)

Compounds represented by the following formula (1) or (2) are preferred as the phosphate metal salt (component C). These phosphate metal salts may be used alone or in combination.

(1)

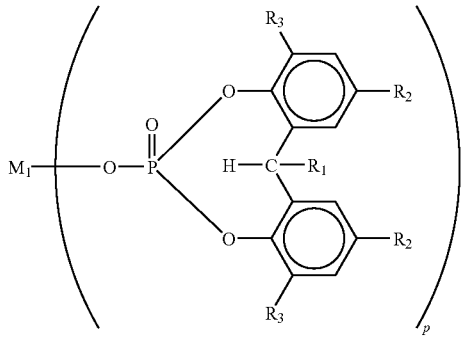

In the formula (1), $R_1$ is a hydrogen atom or alkyl group having 1 to 4 carbon atoms. Examples of the alkyl group having 1 to 4 carbon atoms represented by $R_1$ include methyl group, ethyl group, n-propyl group, iso-propyl group, n-butyl group, sec-butyl group and iso-butyl group.

$R_2$ and $R_3$ are each independently a hydrogen atom or alkyl group having 1 to 12 carbon atoms. Examples of the alkyl group having 1 to 12 carbon atoms include methyl group, ethyl group, n-propyl group, iso-propyl group, n-butyl group, sec-butyl group, iso-butyl group, tert-butyl group, amyl group, tert-amyl group, hexyl group, heptyl group, octyl group, iso-octyl group, tert-octyl group, 2-ethylhexyl group, nonyl group, iso-nonyl group, decyl group, iso-decyl group, tert-decyl group, undecyl group, dodecyl group and tert-dodecyl group.

$M_1$ is an alkali metal atom such as Na, K and Li, or alkali earth metal atom such as Mg or Ca. P is 1 or 2.

Out of the phosphate metal salts represented by the formula (1), phosphate metal salts in which $R_1$ is a hydrogen atom and $R_2$ and $R_3$ are both tert-butyl groups are preferred.

(2)

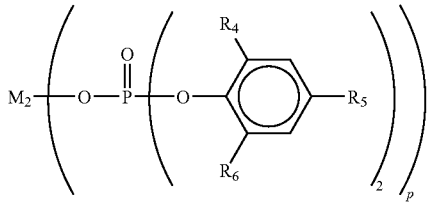

In the formula (2), $R_4$, $R_5$ and $R_6$ are each independently a hydrogen atom or alkyl group having 1 to 12 carbon atoms. Examples of the alkyl group having 1 to 12 carbon atoms include methyl group, ethyl group, n-propyl group, iso-propyl group, n-butyl group, sec-butyl group, iso-butyl group, tert-butyl group, amyl group, tert-amyl group, hexyl group, heptyl group, octyl group, iso-octyl group, tert-octyl group, 2-ethylhexyl group, nonyl group, iso-nonyl group, decyl group, iso-decyl group, tert-decyl group, undecyl group, dodecyl group and tert-dodeocyl group.

$M_2$ is an alkali metal atom such as Na, K or Li, or alkali earth metal atom such as Mg or Ca. p is 1 or 2.

Out of the phosphate metal salts represented by the formula (2), phosphate metal salts in which $R_4$ and $R_6$ are methyl groups and $R_5$ is a tert-butyl group are preferred. Examples of the phosphate metal salt include the NA-11 of ADEKA CORPORATION. The phosphate metal salt can be synthesized by a known method.

As described in JP-A 2003-192884, a compound represented by the formula (1) or (2) is known as a crystal nucleating agent for polylactic acid. However, the present invention is characterized in that $M_1$ and $M_2$ in the formulas (1) and (2) are each an alkali metal atom or alkali earth metal atom. When $M_1$ and $M_2$ in the formulas (1) and (2) are other metals such as aluminum, the heat resistance of the compound itself is low and a sublimed product may be produced at the time of spinning, thereby making spinning difficult.

The phosphate metal salt (component C) has an average primary particle diameter of preferably 0.01 to 10 μm, more preferably 0.05 to 7 μm. It is difficult to reduce the particle diameter to a value smaller than 0.01 μm industrially, and it is not necessary to reduce the particle diameter so much. When the particle diameter is larger than 10 μm, the frequency of yarn break increases at the time of spinning and stretching.

The content of the phosphate metal salt (component C) is preferably 0.01 to 5 parts by weight, more preferably 0.05 to 5 parts by weight, much more preferably 0.05 to 4 parts by weight, particularly preferably 0.1 to 3 parts by weight based on 100 parts by weight of the total of the poly(L-lactic acid) (component A) and the poly(D-lactic acid) (component B). When the content is lower than 0.01 part by weight, a desired effect is rarely observed. When the content is higher than 5 parts by weight, thermal decomposition or yarn break may occur at the time of forming a fiber disadvantageously.

The (weight) ratio of the poly(L-lactic acid) (component A) to the poly(D-lactic acid) (component B) is preferably 40/60 to 60/40, more preferably 45/55 to 55/45, much more preferably 50/50.

The components A, B and C may be mixed together by using conventionally known means. For example, the components A, B and C may be mixed together by means of a tumbler, twin-cylinder mixer, super-mixer, Nauter mixer, Banbury mixer, kneading roll, or single-screw or double-screw extruder.

The composition obtained as described above is melt mixed and may be transferred to a spinning machine directly or through a metering pump. The temperature for melt mixing the composition is preferably higher than the melting point of the obtained stereocomplex polylactic acid, more preferably higher than 220° C. A pellet of the composition may be supplied into the spinning machine. Preferably, the pellet has a length of 1 to 7 mm, a long diameter of 3 to 5 mm and a short diameter of 1 to 4 mm. It is preferred that there should be no variation in the shape of the pellet. The pellet of the composition may be transferred to the spinning machine by using an ordinary melt extruder such as a pressure melter or single-screw or double-screw extruder. For the formation of the stereocomplex crystal, it is important that the components A and B should be mixed together fully, preferably under shear stress.

The composition may contain a carbodiimide compound. When the composition contains a carbodiimide compound, the thermal decomposition resistance and hydrolysis resistance of the obtained composition are improved.

Examples of the carbodiimide compound include monocarbodiimide compounds and polycarbodiimide compounds such as dicyclohexyl carbodiimide, diisopropyl carbodiimide, diisobutyl carbodiimide, dioctyl carbodiimide, octyldecyl carbodiimide, di-tert-butyl carbodiimide, dibenzyl carbodiimide, diphenyl carbodiimide, N-octadecyl-N'-phenyl carbodiimide, N-benzyl-N'-phenyl carbodiimide, N-benzyl-N'-tolyl carbodiimide, di-o-toluoyl carbodiimide, di-p-toluoyl carbodiimide, bis(p-aminophenyl)carbodiimide, bis(p-chlorophenyl)carbodiimide, bis(o-chlorophenyl) carbodiimide, bis(o-ethylphenyl)carbodiimide, bis(p-ethylphenyl)carbodiimide, bis(o-isopropylphenyl) carbodiimide, bis(p-isopropylphenyl)carbodiimide, bis(o-isobutylphenyl)carbodiimide, bis(p-isobutylphenyl) carbodiimide, bis(2,5-dichlorophenyl)carbodiimide, bis(2,6-dimethylphenyl)carbodiimide, bis(2,6-diethylphenyl) carbodiimide, bis(2-ethyl-6-isopropylphenyl)carbodiimide, bis(2-butyl-6-isopropylphenyl)carbodiimide, bis(2,6-diisopropylphenyl)carbodiimide, bis(2,6-di-tert-butylphenyl)carbodiimide, bis(2,4,6-trimethylphenyl)carbodiimide, bis(2,4,6-triisopropylphenyl)carbodiimide, bis(2,4,6-tributylphenyl) carbodiimide, di-β-naphthylcarbodiimide, N-tolyl-N'-cyclohexylcarbodiimide, N-tolyl-N'-phenylcarbodiimide, p-phenylenebis(o-toluylcarbodiimide), p-phenylenebis(cyclohexylcarbodiimide, p-phenylenebis(p-chlorophenylcarbodiimide), 2,6,2',6'-tetetraisopropyldiphenyl carbodiimide, hexamethylenebis(cyclohexylcarbodiimide), ethylenebis (phenylcarbodiimide) and ethylenebis(cyclohexylcarbodiimide).

Commercially available polycarbodiimide compounds include Carbodilites (trade name) marketed from Nisshinbo Industries, Inc. such as Carbodilite LA-1 and Carbodilite HMV-8CA.

When the composition is molten at 260° C., its weight average molecular weight is preferably reduced by not more than 20%. When a molecular weight reduction at a high temperature is large, spinning becomes difficult and the physical properties of the obtained yarn deteriorate disadvantageously.

The composition has preferably a water content of not more than 100 ppm. When the water content is high, the hydrolysis of the poly(L-lactic acid) component and the poly (D-lactic acid) component is promoted and the molecular weight of the composition is significantly reduced, making spinning difficult and also deteriorating the physical properties of the obtained yarn disadvantageously.

The amount of the residual lactide in the composition is preferably not more than 3,000 ppm, more preferably not more than 1,000 ppm, particularly preferably not more than 400 ppm. The lactide contained in the polylactic acid obtained by the lactide method is evaporated at the time of melt spinning, thereby causing yarn nonuniformity. Therefore, it is preferred to reduce the amount of lactide to not more than 400 ppm in order to obtain high-quality yarn.

(Melt Spinning)

The composition is molten by means of an extruder type or pressure melter type melt extruder, weighed by means of a gear pump, filtered in a pack and ejected from nozzles formed in the spinneret as monofilaments or multifilaments to be spun into yarn. The shape and number of spinnerets are not particularly limited and a circular, atypical, solid or hollow spinneret may be used. The ejected yarn is cooled to be solidified right away, bundled, applied by a lubricant and wound up. The winding rate is not particularly limited but preferably 300 to 5,000 m/min. From the viewpoint of stretchability, the winding rate is preferably a value which ensures that the stereo crystallization ratio of the unstretched yarn becomes 0%. The wound unstretched yarn is then supplied to the stretching step. The spinning step and the stretching step do not need to be separated from each other, and a direct spinning/stretching method in which stretching is carried out after spinning without winding up the yarn may be employed.

The fiber of the present invention is obtained by a melt spinning method. Dry or wet solution spinning has low productivity from the industrial point of view, and stable yarn is hardly obtained due to the low stability of a solution containing poly(L-lactic acid) and poly(D-lactic acid).

It is known that polylactic acid forming a stereocomplex crystal has at least two heat absorption peaks derived from a low-temperature crystal melting phase (a) at a temperature lower than 195° C. and a high-temperature crystal melting phase (b) at 195° C. or higher according to constituent components, composition ratio and conditions for forming stereocomplex.

In the present invention, the molten composition used for spinning is substantially amorphous in the wide-angle X-ray diffraction measurement. When it is measured by a differential scanning calorimeter (DSC), it does not show at least two heat absorption peaks derived from the low-temperature crystal melting phase (a) and the high-temperature crystal melting phase (b) but substantially a single melting peak derived from the stereocomplex crystal. The melting peak temperature is 195° C. or higher.

As a result, the spun unstretched yarn is substantially amorphous in the wide-angle X-ray diffraction measurement and shows substantially a single melting peak derived from the stereocomplex crystal in the DSC measurement. That is, the unstretched yarn has substantially a single melting peak in the differential scanning calorimeter (DSC) measurement, and the melting peak temperature is 195° C. or higher. According to the manufacturing method of the preset invention, the unstretched yarn forms amorphous stereocomplex but it is assumed that the unstretched yarn does not contain a poly(L-lactic acid) phase and/or a poly(D-lactic acid) phase capable of forming a low-temperature crystal phase. These features are due to the fact that the fiber contains the phosphate metal salt (component C) and are useful features that were not anticipated at all in the prior art. The number of yarn nonuniformities becomes small and the step of stabilizing winding properties and stretchability can be provided by forming this unstretched yarn having a single melting peak.

Two melting peaks derived from the homocrystal and stereocomplex crystal of poly(L-lactic acid) and poly(D-lactic acid) are seen in ordinary unstretched yarn containing no phosphate metal salt (component C) in the differential scanning calorimeter (DSC) measurement.

(Stretching)

Stretching may be carried out in one stage or multiple stages, and the draw ratio is preferably 3 times or more, more preferably 4 to 10 times in order to manufacture a high-strength fiber. However, when the draw ratio is too high, the fiber is devitrified and whitened, whereby the strength of the fiber is reduced. Preheating for stretching may be carried out by increasing the temperature of a roll or using a plate-like or pin-like contact heater, non-contact hot plate or heat medium bath. The stretching temperature is preferably 70 to 140° C., more preferably 80 to 130° C.

The low-temperature crystal melting phase (a) is substantially not seen at all and only a single melting peak derived from the high-temperature crystal melting phase (b) is seen in the stretched yarn. The melting start temperature of the high-temperature crystal melting phase (b) of the stretched yarn is preferably 190° C. or higher, more preferably 200° C. or higher. In addition, the stereo crystallization ratio (Sc ratio) obtained from the integral intensity of the diffraction peaks of the stereocomplex crystal measured by the wide-angle X-ray diffraction of the stretched yarn is not less than 90%. These features are due to the fact that the fiber contains the phosphate metal salt (component C) and are useful features which were not anticipated at all in the prior art.

(Heat Treatment)

The heat treatment step is to heat the stretched yarn.

The heat treatment is carried out at 150 to 220° C., preferably 170 to 220° C., more preferably 180 to 200° C. The heat treatment is preferably carried out under tension. The heat treatment may be carried out with a hot roller, contact type heater or non-contact hot plate. The heat treatment may be carried out continuously from the stretching step or separately from the stretching step. A fiber having a high stereo crystallization ratio, excellent heat shrinkage resistance and iron resistance and a strength of not less than 2.5 cN/dTex can be obtained by the heat treatment. When the stretched yarn is heated at a temperature lower than 150° C., a satisfactory stereo crystallization ratio is not obtained, thereby causing problems with heat shrinkage resistance and iron resistance.

In the present invention, as the stretched yarn does not have the low-temperature crystal melting phase of poly(L-lactic acid) or poly(D-lactic acid), even when it is heated at a temperature equal to or higher than the crystal melting point of poly(L-lactic acid) or poly(D-lactic acid), thermal fusion or breakage caused by the partial melting of the homocrystal of poly(L-lactic acid) or poly(D-lactic acid) does not occur, and the stretched yarn can be heated at 170° C. or higher which is higher than the melting point of the homocrystal, for example, 190° C. As a result, a fiber having a high stereo crystallization ratio and excellent strength and heat resistance can be obtained. Since this fiber has high heat resistance, it rarely experiences a trouble such as thermal fusion at the time of manufacture and has excellent heat shrinkage resistance.

<Fiber>

The fiber of the present invention is made of a composition comprising the components A, B and C and has a strength of 2.5 to 10 cN/dTex. The components A, B and C have already been described above.

The strength of the fiber of the present invention is preferably not less than 2.5 cN/dTex, more preferably not less than 3.8 cN/dTex, much more preferably not less than 4.0 cN/dTex. The upper limit is preferably higher but actually about 10 cN/dTex. When it is used for apparel and industrial purposes, a fiber having a strength of not less than 4.0 cN/dTex is preferred because its practical application range is wide.

The fiber of the present invention has a heat shrinkage factor at 150° C. of preferably 0.1 to 15%, more preferably 0.1 to 7%, much more preferably 0.2 to 6.5%, particularly preferably 0.3 to 6%, ideally 0.5 to 6%. If the heat shrinkage factor is large, when a fiber product is exposed to a high temperature such as ironing, it shrinks and becomes smaller and cannot be put to practical use.

The stereo crystallization ratio of the fiber of the present invention is preferably 90 to 100%, more preferably 95 to 100%, much more preferably 98 to 100%.

The fiber of the present invention has substantially a single melting peak in the differential scanning calorimeter (DSC) measurement, the melting peak temperature is 195° C. or higher, and the stereo crystallization ratio obtained by the wide-angle X-ray diffraction (XRD) measurement is not less than 90%. The fiber of the present invention has iron resistance at 170° C.

<Fiber Product>

The fiber of the present invention may be used as original yarn for yarn processing such as false-twisting, mechanical-crimping or stuffer-box texturing. Further, it may be formed into a long fiber, short fiber or spun yarn comprising short fibers. Since the fiber of the present invention has a high stereo crystallization ratio and excellent strength, heat resistance and shrinkage resistance, it can provide various fiber products such as a woven fabric, knitted fabric and non-woven fabric. That is, the present invention includes a fiber product comprising the fiber of the present invention.

Stated more specifically, it can be advantageously used in clothing such as shirts, jackets, underwears and coats, clothing materials such as cups and pads, interior goods such as curtains, carpets, mats and furniture, industrial materials such as belts, nets, ropes, heavyweight fabric, bags, felts and filters, and vehicle interior materials.

The fiber of the present invention does not have the homocrystal phase of poly(L-lactic acid) or poly(D-lactic acid). Therefore, even when a fiber product comprising the fiber of the present invention is ironed, there is no possibility that part of the fiber is softened, molten and shrunk. Since the quality, texture and size of the fiber product of the present invention are not impaired by ironing, it can be expected to be used for industrial application in which it is used at a high temperature.

EXAMPLES

The following examples are provided for the purpose of further illustrating the present invention but are in no way to be taken as limiting. The values in the examples were obtained by the following methods.

(1) Reduction Viscosity:

0.12 g of the polymer was dissolved in 10 ml of tetrachloroethane/phenol (volume ratio of 1/1) to measure its reduction viscosity (ml/g) at 35° C.

(2) Weight Average Molecular Weight (Mw):

The weight average molecular weight of the polymer was obtained with GPC (column temperature of 40° C., chloroform) by comparison with a polystyrene standard sample.

(3) Stereo Crystallization Ratio (Sc Ratio)

An X-ray diffraction diagram was recorded on an imaging plate by using the ROTA FLEX RU200B X-ray diffraction apparatus of Rigaku Denki Co., Ltd. in accordance with the transmission method under the following conditions. In the obtained X-ray diffraction diagram, a diffraction intensity profile in the equator direction was obtained and then the stereo crystallization ratio (Sc ratio) was obtained from the total $\Sigma I_{sci}$ of the integral intensities of diffraction peaks derived from the stereocomplex crystal which appeared around at $2\theta=12.0°$, 20.7° and 24.0° and the integral intensity IM of a diffraction peak derived from a homocrystal which appeared around at $2\theta=16.50$ in accordance with the following formula. $\Sigma I_{sci}$ and $I_{HM}$ were estimated by eliminating diffuse scattering caused by the background or amorphia from the diffraction intensity profile in the equator direction as shown in FIG. 1.

X-ray source: Cu-Kα line (confocal mirror)

Output: 45 kV×70 mA

Slit: 1 mm to 0.8 mm in diameter

Camera length: 120 mm
Integral time: 10 minutes
Sample: length of 3 cm, 35 mg
Sc ratio (%)=$\Sigma I_{sci}/(\Sigma I_{sci}+I_{HM})\times 100$
($\Sigma I_{sci}=I_{SC1}+I_{SC2}+I_{SC3}$, and $I_{sci}$ (i=1 to 3) is the integral intensity of a diffraction peak around at 2θ=12.0°, 20.7° or 24.0°.)

(4) Melting Point, Crystal Melting Peak, Crystal Melting Start Temperature, Crystal Melting Enthalpy Measurement:

The TA-2920 differential scanning calorimeter (DSC) of TA Instruments Co., Ltd. was used. 10 mg of the sample was heated from room temperature to 260° C. at a temperature elevation rate of 10° C./min in a nitrogen atmosphere. The homocrystal melting peak, homocrystal melting (start) temperature, homocrystal melting enthalpy, stereocomplex crystal melting peak, stereocomplex crystal melting (start) temperature and stereocomplex crystal melting enthalpy were obtained by first scanning.

(5) Strength, Elongation

These were measured at a sample length of 25 cm and a tensile rate of 30 cm/min by using the "Tensilon" tensile tester of Orientec Co., Ltd.

(6) Iron Resistance

A 10 cm×10 cm dishcloth was made from the fiber to be tested and ironed with an iron having a surface temperature of 170° C. for 30 seconds to evaluate the heat resistance of the fiber based on changes in the shape, size and Texture of the dishcloth. The following criteria were used.

Acceptable: ○ the shape, size and Texture of the dishcloth before the treatment are well maintained without the fusion of single yarn Unacceptable: X the fusion of single yarn or the thermal deformation and rough texture of the dishcloth before the treatment are seen (7) Measurement of Heat Shrinkage Factor at 150° C.

This was measured in accordance with JIS L-1013 8. 18. 2. a).

Production Example 1

Production of Polymer A1

100 parts by weight of L-lactide having an optical purity of 99.8% (manufactured by Musashino Chemical Laboratory, Ltd.) was added to a polymerizer, the inside of the polymerizer was substituted by nitrogen, and 0.2 part by weight of stearyl alcohol and 0.05 part by weight of tin octylate as a catalyst were added to carry out polymerization at 190° C. for 2 hours so as to produce a polymer. This polymer was washed in a 7% acetone solution of 5N hydrochloric acid to remove the catalyst so as to obtain polymer A1. The obtained polymer A1 had a reduction viscosity of 2.92 (ml/g) and a weight average molecular weight of 190,000. It had a melting point (Tm) of 168° C. Its crystallization point (Tc) was 122° C.

Production Example 2

Production of Polymer A2

100 parts by weight of D-lactide having an optical purity of 99.8% (manufactured by Musashino Chemical Laboratory, Ltd.) was added to a polymerizer, the inside of the polymerizer was substituted by nitrogen, and 0.2 part by weight of stearyl alcohol and 0.05 part by weight of tin octylate as a catalyst were added to carry out polymerization at 190° C. for 2 hours so as to produce a polymer. This polymer was washed in a 7% acetone solution of 5N hydrochloric acid to remove the catalyst so as to obtain polymer A2. The obtained polymer A2 had a reduction viscosity of 2.65 (ml/g) and a weight average molecular weight of 200,000. It had a melting point (Tm) of 176° C. Its crystallization point (Tc) was 139° C.

Example 1

(Molten Spun Yarn)

Chips of the polymers A1 and A2 were prepared and mixed together in a A1/A2 weight ratio of 50/50 by a twin-cylinder mixer to prepare a chip blend which was then dried at 110° C. under reduced pressure for 5 hours. 0.5 part by weight of sodium 2,2-methylenebis(4,6-di-tert-butylphenol)phosphate (Adecastab NA-11) (average particle diameter of 5 μm) was added to 100 parts by weight of this chip, and the resulting mixture was molten at 230° C. by a melt spinning machine having a double-screw extruder and ejected from a spinneret having 201 ejection holes with a diameter of 0.25 μm at a rate of 350 g/min.

The obtained yarn was cooled by a spinning cylinder, bundled, applied by a lubricant and wound up at a rate of 1,250 m/min to obtain unstretched yarn. This unstretched yarn had a Sc ratio of 0% and had a single crystal melting peak derived from stereocomplex at 224° C. when measured by a differential scanning calorimeter (DSC).

(Stretching, Heat Treatment)

This unstretched yarn was stretched to 3.5 times by preheating at 70° C. and heated at 180° C. to obtain a fiber having a fineness of 579 dTex/201 fil. The obtained fiber showed a single melting peak derived from a stereocomplex crystal composed of poly(L-lactic acid) and poly(D-lactic acid) in the differential scanning calorimeter (DSC) measurement and had a melting point of 224° C. The fiber had a Sc ratio in the wide-angle X-ray diffraction measurement of 100%, a strength of 3.3 cN/dTex, an elongation of 35% and a heat shrinkage factor at 150° C. of 5%. When the obtained fiber was formed into a cylinder net to carry out an ironing test at 170° C., a rupture, perforation, fusion, roughening/hardening and dimensional change were not seen and the fiber was evaluated as ○. These results are shown in Tables 1 and 2.

Examples 2 to 4

The operation of Example 1 was repeated except that the amount and heat treatment temperature of the phosphate metal salt were changed. At this point, spinnability and stretchability were satisfactory, and yarn break, fluff and fusion were rarely seen. The results are shown in Tables 1 and 2. The obtained fiber showed a single melting peak derived from a stereocomplex crystal in the DSC measurement, and the melting peak temperature was 210° C. or higher.

Comparative Examples 1 and 2

The operation of Example 1 was repeated except that the phosphate metal salt was not used and the heat treatment temperature was changed to 155° C. and 180° C. The results are shown in Tables 1 and 2.

Example 5

When only the average particle diameter of the phosphate metal salt in Example 1 was changed to 15 μm, the number of fluffs slightly increased at the time of spinning and stretching. However, this increase was not so big to become an industrial problem, and good stretched yarn could be obtained. Differences in physical properties between the stretched yarn of Example 1 and the stretched yarn of Example 5 were not seen.

Comparative Example 3

When the operation of Example 1 was repeated except that 0.5 part by weight of aluminum 2,2-methylenebis(4,6-di-tert-butylphenylphosphate) hydroxide (Adecastab NA-21) was used as the phosphate metal salt, a sublimed product was violently produced at the time of spinning, making spinning difficult.

TABLE 1

| | Unit | Example 1 | Example 2 | Example 3 | Example 4 | Comparative Example 1 | Comparative Example 2 | Comparative Example 3 |
|---|---|---|---|---|---|---|---|---|
| Type of phosphate metal salt | — | 1 | 1 | 1 | 1 | — | — | 2 |
| Amount of phosphate metal salt | parts by weight | 0.5 | 0.5 | 0.1 | 1 | — | — | 0.5 |
| Spinning temperature | ° C. | 230 | 230 | 230 | 230 | 230 | 230 | 230 |
| Stretching temperature | ° C. | 70 | 95 | 70 | 110 | 70 | 70 | — |
| Draw ratio | — | 3.5 | 3 | 3.5 | 2.9 | 3.5 | 3.5 | — |
| Heat treatment temperature | ° C. | 180 | 185 | 180 | 180 | 155 | 180 | — |

Phosphate metal salt
1: sodium 2,2-methylenebis(4,6-di-tert-butylphenol)phosphate
2: aluminum 2,2-methylenebis(4,6-di-tert-butylphenylphosphate)hydroxide

TABLE 2

| | | Unit | Ex. 1 | Ex. 2 | Ex. 3 | Ex. 4 | C. Ex. 1 | C. Ex. 2 | C. Ex. 3 |
|---|---|---|---|---|---|---|---|---|---|
| Unstretched yarn | Sc ratio | % | 0 | 0 | 0 | 0 | 0 | 0 | — |
| | Melting peak | | single | single | single | single | two | two | — |
| | Melting peak temperature | ° C. | 220 | 220 | 221 | 218 | 168/220 | 168/220 | — |
| Fiber after stretching and heat treatment | Sc ratio | % | 100 | 100 | 95 | 98 | 25 | 85 | — |
| | Melting peak | | single | single | single | single | single | single | — |
| | Melting peak temperature | ° C. | 224 | 225 | 224 | 220 | 224 | 224 | — |
| | Fiber strength | cN/dTe | 3.3 | 2.8 | 3.2 | 3 | 1.8 | Note 1 | — |
| | Shrinkage factor at 150° C. | % | 5 | 2.3 | 3.2 | 5 | 5 | Note 1 | — |
| | Iron resistance at 170° C. | — | ○ | ○ | ○ | ○ | ○ | ○ | — |

Ex.: Example
C. Ex.: Comparative Example
Note 1: Since the fusion of single yarn and yarn break were significant when the heat treatment temperature was 180° C., proper stretching was impossible.

EFFECT OF THE INVENTION

The fiber of the present invention is substantially composed of only a stereocomplex phase and has excellent strength and heat resistance and a low heat shrinkage factor.

In the manufacturing method of the present invention, a composition comprising poly(L-lactic acid) (component A), poly(D-lactic acid) (component B) and a phosphate metal salt (component C) is melt spun into yarn. Since this molten composition is substantially amorphous in wide-angle X-ray diffraction measurement and shows substantially a single melting peak derived from a stereocomplex crystal in the DSC measurement, it has such high spinnability that it can be spun and stretched stably.

The obtained unstretched yarn and stretched yarn are substantially amorphous in the wide-angle X-ray diffraction measurement and shows substantially a single melting peak derived from a stereocomplex crystal in the DSC measurement. As a result, even when the yarn is heated at a temperature equal to or higher than the crystal melting points of poly(L-lactic acid) and poly(D-lactic acid), a fiber having a high stereo crystallization ratio and excellent strength and heat resistance can be obtained without the partial melting of poly(L-lactic acid) and poly(D-lactic acid).

Industrial Feasibility

Since the fiber of the present invention has a high stereo crystallization ratio and excellent strength, heat resistance and shrinkage resistance, it can provide various fiber products such as a woven fabric, knitted fabric and non-woven fabric.

The invention claimed is:

1. A fiber made of a composition which comprises (i) poly(L-lactic acid) having a weight average molecular weight of 50,000 to 300,000 (component A), (ii) poly(D-lactic acid) having a weight average molecular weight of 50,000 to 300,000 (component B) and (iii) 0.05 to 5 parts by weight of a phosphate metal salt (component C) based on 100 parts by weight of the total of the components A and B and (iv) the fiber has a strength of 2.5 to 10 cN/dTex, and (v) the fiber has substantially a single melting peak in differential scanning calorimeter (DSC) measurement, a melting peak temperature of 195° C. or higher, and a stereo crystallization ratio in wide-angle X-ray diffraction (XRD) measurement of not less than 90%, wherein the phosphate metal salt (component C) is a compound represented by the following formula (1) or (2):

(1)

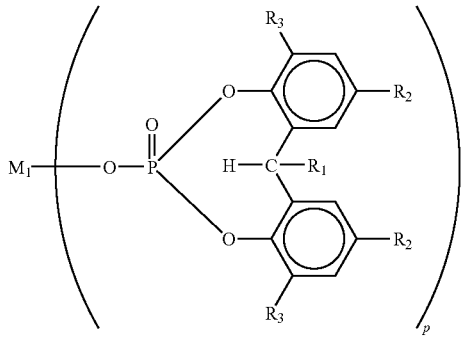

wherein $R_1$ is a hydrogen atom or alkyl group having 1 to 4 carbon atoms, $R_2$ and $R_3$ are each independently a hydrogen atom or alkyl group having 1 to 12 carbon atoms, $M_1$ is an alkali metal atom or alkali earth metal atom, and p is 1 or 2, (2)

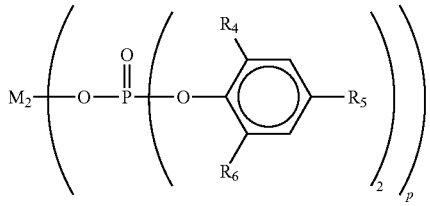

wherein $R_4$, $R_5$ and $R_6$ are each independently a hydrogen atom or alkyl group having 1 to 12 carbon atoms, $M_2$ is an alkali metal atom or alkali earth metal atom, and p is 1 or 2.

2. The fiber according to claim 1 which has a heat shrinkage factor at 150° C. of 0.1 to 7%.

3. The fiber according to claim 1 which has iron resistance at 170° C.

4. A fiber product comprising the fiber of claim 1.

5. A method of manufacturing a fiber, comprising the steps of:

(1) melt spinning a composition which comprises (i) poly(L-lactic acid) having a weight average molecular weight of 50,000 to 300,000 (component A), (ii) poly(D-lactic acid) having a weight average molecular weight of 50,000 to 300,000 (component B) and (iii) 0.05 to 5 parts by weight of a phosphate metal salt (component C) based on 100 parts by weight of the total of the components A and B to obtain unstretched yarn, wherein the unstretched yarn has substantially a single melting peak in the differential scanning calorimeter (DSC) measurement, and the melting peak temperature is 195° C. or higher and the unstretched yarn is substantially amorphous in a wide-angle diffraction measurement;

(2) stretching the unstretched yarn to obtain stretched yarn; and (3) heating the stretched yarn at 170 to 220° C., wherein the phosphate metal salt (component C) is a compound represented by the following formula (1) or (2):

(1)

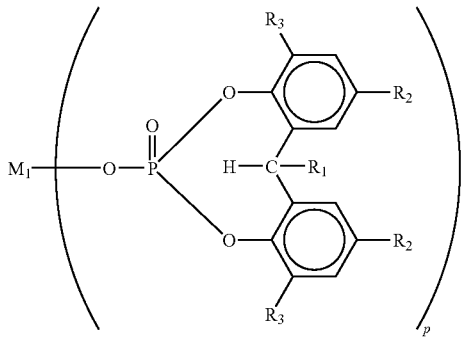

wherein $R_1$ is a hydrogen atom or alkyl group having 1 to 4 carbon atoms, $R_2$ and $R_3$ are each independently a hydrogen atom or alkyl group having 1 to 12 carbon atoms, $M_1$ is an alkali metal atom or alkali earth metal atom, and p is 1 or 2, (2)

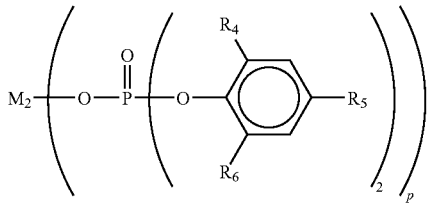

wherein $R_4$, $R_5$ and $R_6$ are each independently a hydrogen atom or alkyl group having 1 to 12 carbon atoms, $M_2$ is an alkali metal atom or alkali earth metal atom, and p is 1 or 2.

6. The manufacturing method according to claim 5, wherein the phosphate metal salt is particulate with an average particle diameter of 0.01 to 10 μm.

* * * * *